US005205478A

United States Patent [19]

Wiscusen, III et al.

[11] Patent Number: 5,205,478

[45] Date of Patent: Apr. 27, 1993

[54] END-LOADING, HOODED CONTAINER

[75] Inventors: Henry Wiscusen, III, Lilburn; Jerry A. Garmon, Lawrenceville, both of Ga.

[73] Assignee: Rock-Tenn Company, Norcross, Ga.

[21] Appl. No.: 708,928

[22] Filed: May 31, 1991

[51] Int. Cl.[5] ..... B65D 5/20; B65D 5/54

[52] U.S. Cl. ..... 229/145; 229/226

[58] Field of Search ..... 229/145, 225-227; 206/621, 624, 629

[56] References Cited

U.S. PATENT DOCUMENTS

| | | | |
|---|---|---|---|
| 2,768,777 | 10/1956 | Barrington et al. | 229/145 |
| 3,073,501 | 1/1963 | Williamson . | |
| 3,109,577 | 11/1963 | Knipp | 229/145 |
| 3,353,740 | 11/1967 | Outwater | 206/624 |
| 3,506,184 | 4/1970 | Barnes | 229/145 |
| 3,554,432 | 1/1971 | William . | |
| 3,833,165 | 9/1974 | Hoiles | 229/145 |
| 4,046,313 | 9/1977 | Perry | 206/624 |
| 4,358,918 | 11/1982 | Groom et al. . | |
| 4,441,614 | 4/1984 | Gulliver . | |
| 4,503,659 | 3/1985 | Sherman . | |
| 4,524,564 | 6/1985 | Groom et al. . | |
| 4,676,430 | 6/1987 | Wischusen, III . | |
| 4,732,315 | 3/1988 | Gunn . | |
| 4,759,167 | 7/1988 | Langen et al. . | |
| 4,869,052 | 9/1989 | Calvert . | |
| 4,875,323 | 10/1989 | Craighead . | |
| 4,907,698 | 3/1990 | Konrad et al. | 229/227 |
| 5,592,190 | 6/1986 | Sherman et al. . | |

FOREIGN PATENT DOCUMENTS

| | | | |
|---|---|---|---|
| 1903982 | 9/1969 | Fed. Rep. of Germany | 229/145 |
| 2735267 | 2/1979 | Fed. Rep. of Germany | 229/145 |
| 1015504 | 10/1952 | France | 229/145 |

*Primary Examiner*—Gary E. Elkins

*Attorney, Agent, or Firm*—Jones & Askew

[57] ABSTRACT

A disposable enclosed container is provided which is loaded with product from an end and accessed through a hooded top for dispensing of product. An end construction comprising a leading minor flap panel, a trailing minor flap panel, an inner major flap panel, an intermediate minor flap panel, and an outer major flap panel allows a blank to be assembled into a sleeve for loading of product and to be subsequently assembled into a container which may be opened into a tray and hooded top for dispensing of product. An apparatus for erecting and loading the sleeve, and then assembling the ends of the sleeve to form the container is also disclosed.

6 Claims, 7 Drawing Sheets 10
14
62
64
89
88
89
91
40
42
36
70
74
38
92
70
86
56
28
37
74
46
51
58
33
24
90
26
56
32
92
12
58
82

74
64
32
20
62
26
50
70
36
46
93
92
82
90
44
58
51
28
33
56
52
M

M
20
44
45
46
50
51
52
56
58
62
70
74
80
82
90
93

END-LOADING, HOODED CONTAINER

TECHNICAL FIELD

The present invention relates generally to a disposable container formed from foldable sheet material, and more particularly relates to a container and a machine for erecting, loading, and closing a container which is loaded with product from an end and which provides a hooded, broad top opening for dispensing of product.

BACKGROUND OF THE INVENTION

In the prepackaged food industry, baked products are typically sold in paperboard containers which have a tray and a hooded top. Such containers are generally erected from one-piece blanks and are popular among consumers because they are easy to open, provide a broad, top opening through which baked products may be removed or replaced, and are readily re-closed to maintain product freshness. These containers, however, have several disadvantages from a packager's perspective. For example, typical hooded containers are difficult to load with product using automated methods because loading may only be accomplished by lifting the product and setting it into the tray with the hooded top open. This is difficult to do using automated methods, is time consuming, and may result in damage to delicate baked goods. To eliminate these disadvantages for the packager yet maintain the advantages of the tray and hooded top combination for the consumer, it has been proposed to provide a container which permits packagers to horizontally load or slide the product through an end or side of the container, yet allows consumers access through a hooded top.

One example of a side-loading, top-dispensing container is shown in U.S. Pat. No. 4,441,614. The '614 patent discloses a carton which is partially assembled for horizontal loading of product through a side of the carton and is then fully assembled to provide a carton having a hooded top for access to the product. The loaded carton is fully erected by manipulation of a pair of bottom end flap tabs, a pair of end tabs, a front panel, and a closure panel. The flaps are offset to permit folding of the bottom end flap tabs without interfering with the end tabs. The closure panel is adhesively secured to the end tabs and the front panel. To open the carton from the top, the closure panel is separated from the front panel to provide a hood structure formed by the closure panel, the end tabs, a cover panel and a pair of end flaps.

Another example of a side or end-loading container is disclosed in U.S. Pat. No. 3,073,501. The '501 patent discloses a hooded carton which may be shipped prior to loading in a flat configuration. In one embodiment (FIGS. 17-22) there is disclosed an erected container having a front cover panel 129 through which the product may be accessed. While the containers of the '614 and '501 patents are more easily loaded than conventional containers which are loaded through a top opening, they differ in appearance from conventional containers and are not as convenient for consumers because they do not provide as broad a top opening for accessing product as do conventional hooded containers.

A further example of a container which is loaded from the side and accessed through a hooded top utilizes a five flap end structure. This container utilizes an end construction having a leading minor flap panel, a trailing minor flap panel, an inner major flap panel having an upper corner portion of one of its ends removed, an intermediate minor flap panel dimensioned to fit within the removed portion or cutout when the container is assembled, and an outer major flap panel. The end of the container is closed by folding the leading and trailing minor flap panels inwardly so that they are in between a top and a bottom panel, folding the inner major flap panel upwardly and adhesively securing it to the leading and trailing minor flap panels, folding the intermediate minor flap panel into the removed area of the inner major flap panel such that the intermediate minor flap panel is removably positioned against the leading minor flap panel, and folding the outer major flap panel against and securing it to the intermediate minor flap panel. This carton is similar in appearance to conventional hooded containers and provides the broad, top access of conventional hooded containers while allowing product to be loaded from an end. However, it has been experienced that this container is not easily constructed by automated equipment and that this construction is only suitable for use with containers having sufficient height to allow a significant corner portion to be removed from the inner major flap panel. In shorter containers this is not possible because in removing the portion from the inner major flap panel, a substantial amount of the height of the inner major flap panel is removed from the end of the panel, leaving little material left at that end to secure to the leading minor flap panel.

Accordingly, despite the various efforts in the prior art, there remains a need for an improved container which may be used for a variety of shapes, depths, and sizes of containers, and which permits product to be loaded from an end or side of the container using automated equipment and accessed through a hooded top which provides a broad top opening.

SUMMARY OF THE INVENTION

The present invention advances the art by providing an end construction that can be utilized in the construction of an improved end loading, top-dispensing disposable container and by providing an apparatus for loading and assembling the container. The end construction can be utilized independent of container size or depth and allows the container to be convertible into a tray having a hooded top. Intermediate flap panels enable the sides of the container to be closed without securing major flap components of the sides together. Tabs which tear when the container is opened can be included to provide evidence of unauthorized opening of the container.

Generally described, the present invention provides an end construction for a container, the end construction comprising a bottom panel; a first side panel and a second side panel extending upwardly from opposite sides of the bottom panel; a top panel foldably connected to an uppermost edge of the first side panel and positioned in a spaced apart relation to the bottom panel; a third side panel extending downwardly from the top panel, the third side panel positioned in parallel, abutting relationship with an exterior surface of the second side panel, a first minor flap panel foldably connected to an end of the first side panel, the first minor flap panel foldably positioned between the bottom panel and the top panel, substantially perpendicular to the first side panel; a second minor flap panel foldably connected to an end of the second side panel, the second minor flap panel foldably positioned between the bottom panel and the top panel, substantially perpendicular to the second side panel; an inner major flap panel foldably connected to an end of the bottom panel, the inner major flap panel foldably positioned against and secured to the first minor flap panel and the second minor flap panel; an intermediate minor flap panel foldably connected to an end of the third side panel, the intermediate minor flap panel removably positioned against an outer surface of the inner major flap panel substantially perpendicular to the third side panel; and an outer major flap panel foldably connected to an end of the top panel, the outer major flap panel foldably positioned against and secured to the intermediate flap panel.

According to a preferred embodiment, the present invention provides a container having a hooded top which is closed over a tray. The tray comprises a bottom panel; a first side panel and a second side panel extending upwardly from opposite sides of the bottom panel; a pair of a first minor flap panels, one foldably connected to each end of the first side panel, each of the first minor flap panels positioned substantially perpendicular to the first side panel between the first and second side panels; a pair of second minor flap panels, one foldably connected to each end of the second side panel, each of the second minor flap panels positioned substantially perpendicular to one of the second side panels between the first and second side panels; and a pair of inner major flap panels, one foldably connected to each end of the bottom panel, each of the inner major flap panels positioned against and secured to one of the first minor flap panels and one of the second minor flap panels. The hooded top is foldably connected to the tray for closing over the tray and comprises a top panel foldably connected to an uppermost edge of the first side panel such that the top panel may be positioned substantially parallel to and spaced apart from the bottom panel when the hooded top is closed over the tray; a third side panel extending from the top panel such that the third side panel may be removably positioned in parallel, abutting relationship with the second side panel when the hooded top is closed over the tray; a pair of intermediate minor flap panels, one foldably connected to each end of the third side panel, each of the intermediate minor flap panels positioned substantially perpendicular to the third side panel adjacent the top panel such that each of the intermediate minor flap panels may be removably positioned against an outer surface of one of the inner major flap panels when the hooded top is closed over the tray; and a pair of outer major flap panels, one foldably connected to each end of the top panel, each of the outer major flap panels positioned against and secured to one of the intermediate minor flap panels.

The preferred construction of the present invention provides a blank which is partially erected into a sleeve for horizontal loading of product through an open end. The ends of the loaded sleeve are then folded in and secured to provide a fully assembled container. To open the container for dispensing of product, a glue seal is broken to convert the container into a tray with a hooded top. Product may be removed and replaced through a broad opening provided when the hooded top is raised upwardly from over the tray.

Another aspect of the present invention provides a machine for closing a loading end of a sleeve formed from a top panel, a bottom panel, a first side panel, a second side panel, and a third side panel foldably connected to one another, the loading end having a leading minor flap panel foldably connected to an end of the first side panel, a trailing minor flap panel foldably connected to an end of the second side panel, an inner major flap panel foldably connected to an end of the bottom panel, an intermediate minor flap panel foldably connected to an end of the third side panel, and an outer major flap panel foldably connected to an end of the top panel, each of the panels of the loading end extending outwardly from the sleeve, the machine comprising:

conveyor means for advancing the sleeve, the sleeve being positioned on the conveyor means such that the loading end of the sleeve is positioned adjacent a side of the conveyor means;

tucking means for positioning the leading and trailing minor flap panels inwardly such they are between the top panel and the bottom panel, the tucking means positioned adjacent to the side of the conveyor means;

first gluing means for placing an amount of adhesive on an outer surface of the leading minor flap panel and an amount of adhesive on an outer surface of the trailing minor flap panel, the first gluing means positioned adjacent to the side of the conveyor means and downstream of the tucking means;

first folding means for positioning the inner major flap panel against the outer surfaces of the leading and trailing minor flap panel, the first folding means positioned adjacent to the side of the conveyor means and downstream of the first gluing means;

second folding means for positioning said intermediate minor flap panel against an outer surface of the inner major flap panel, the second folding means positioned adjacent to the side of the conveyor means and downstream of the first folding means;

second gluing means for placing an amount of glue on an outer surface of the intermediate minor flap panel, the second gluing means positioned adjacent to the side of the conveyor means and downstream of the first folding means; and third folding means for positioning the outer major flap panel against an outer surface of the intermediate minor flap panel, the third folding means positioned adjacent to the side of the conveyor and downstream of the second gluing means.

Thus, it is an object of the present invention to provide an improved end loading, top dispensing disposable container.

It is a further object of the present invention to provide an improved end construction for an end-loading, top dispensing container.

It is yet a further object of the present invention to provide an end loading container which is convertible into a tray having a hooded top.

It is still another object of the present invention to provide a tamper resistant, end-loading, top-dispensing container.

It is yet another object of the present invention to provide an end-loading, top-dispensing container which may be shipped in a flattened configuration.

It is still a further object of the present invention to provide a disposable container which may be loaded with product mechanically through an end and mechanically closed to form a top-dispensing container.

Another aspect of the present invention is to provide a machine which loads product into an open sleeve and closes the ends of the sleeve to form a container which may be opened to provide a tray and a hooded top.

These and other objects, features and advantages of the present invention will become apparent from the following detailed description in conjunction with the appended claims.

BRIEF DESCRIPTION OF THE DRAWINGS

FIGS. 8A–16A are end views of the sleeve of FIG. 2, showing the sequence of steps for assembling the loading end of the sleeve.

FIGS. 8B–16B are end views of the sleeve of FIG. 2, showing the sequence of steps for assembling the rear end of the sleeve.

DETAILED DESCRIPTION OF THE DRAWINGS

Figure 1:
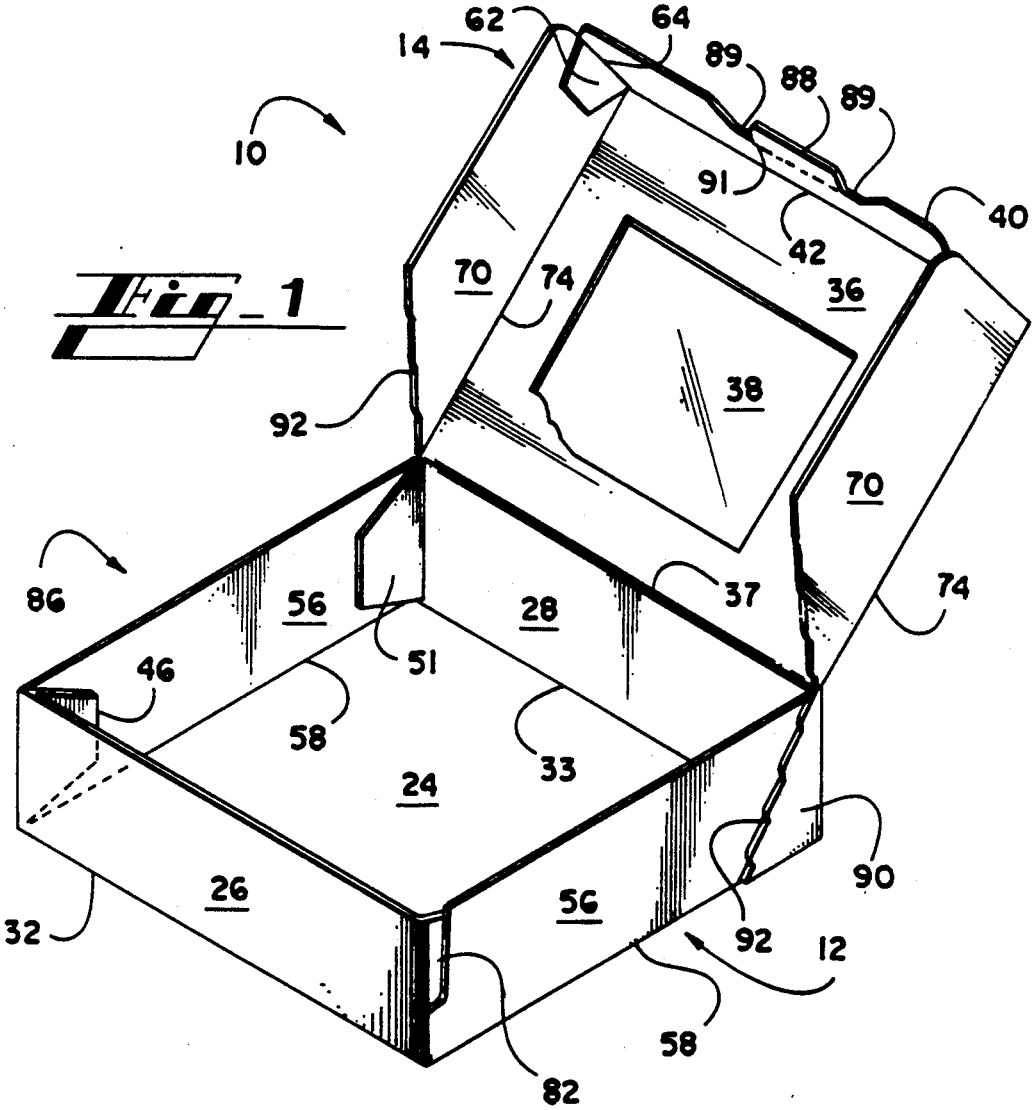
FIG. 1 is a pictorial view of a preferred embodiment showing a container having a tray and a hooded top.

Referring now to the drawings, in which like numerals refer to like parts throughout the several views, FIG. 1 shows a container 10 embodying the present invention, fully assembled and opened to provide a tray 12 and a hooded top 14. The container 10 is formed from a flat blank 10′ of foldable sheet material (shown in FIG. 3), such as paperboard, which is initially erected into a sleeve 20 (shown in FIG. 2) for loading of a product 15 (shown in FIG. 5). A front end 44 and a rear end 45 of the sleeve 20 are assembled to form the container 10. Erection and loading of the sleeve 20, and assembly of the ends 44 and 45 to form the container 10 may be accomplished using a loading/assembly apparatus 100, shown in FIG. 4. The container 10 may then be opened to provided the tray 12 and the hooded top 14 for access to the product 15 through a broad top opening 86.

The container 10 is shown open in FIG. 1 to provide the tray 12 and hooded top 14. The tray 12 includes a bottom panel 24 having a pair of side panels 26 and 28 foldably connected to opposite sides of the bottom panel 24 along scores or fold lines 32 and 33, respectively. Each end of the tray 12 includes a leading minor flap panel 46, a trailing minor flap panel 51, and an inner major flap panel 56 having a cutout 82, as will be described more fully below. The hooded top 14 includes a top panel 36 foldably connected along a score 37 to the uppermost edge of the side panel 28 such that the bottom panel 24 and the top panel 36 are spaced apart when the container 10 is assembled and closed. A window 38, preferably of clear plastic, is optionally provided on the top panel 36 to permit viewing of the product 15 within the container 10. A side panel 40 is foldably connected to the top panel 36 along a score 42 and extends downwardly such that it is oriented parallel to and in contact with the exterior facing surface of the side panel 26 when the hooded top 14 is closed over the tray 12. A lift tab 88 is centrally connected to the lower edge of the side panel 40 along a tear score 91 intermediate a pair of cutouts 89 to facilitate initial opening of the container 10. Each end of the hooded top 14 includes an intermediate minor flap panel 62 extending from the side panel 40, against which is secured an outer major flap panel 70, as will be explained more fully below. To provide evidence of unauthorized opening, a tear score 92 may be provided diagonally across the lowermost, trailing corner of the outer major flap panel 70 to define a tab 90 which separates from the outer major flap panel 70 when the container 10 is initially opened.

The novel end construction allows the sleeve 20 to be loaded with product from the front end 44, and assembled into the container 10 which opens to form the tray 12 and the hooded top 14 for access to the product 15 through the opening 86. Prior to shipment to a packager the blank 10′ (the outside surface of which is shown in FIG. 3) is assembled into a flattened form (not shown) suitable to be erected into the sleeve 20 shown in FIG. 2. To assemble the blank 10′ into the flattened form, the side panel 26 is folded about the score 32 onto the inner surface of the bottom panel 24 and an adhesive, such as cold glue, is applied to points A and B (shown in FIG. 3) on the outward facing surface of the side panel 26. The top panel 36 and the side panel 40 are then folded about the score 37 onto the side panel 28, the bottom panel 24, and the side panel 26 so that the inner surface of the side panel 40 adheres to the adhesive at points A and B on the outer surface of the side panel 26. When needed, the packager erects the flattened sleeve in a conventional manner by exerting inward pressure at the scores 32 and 37 to form the sleeve 20. The packager may then load the product 15 through the front end 44 of the sleeve 20 and close the ends 44 and 45, as discussed below. Erection of the sleeve 20, loading of the product 15 into the sleeve 20, and closure of the ends 44 and 45 of the sleeve 20 may be accomplished manually or with the apparatus 100 shown in FIG. 4.

Figure 2:
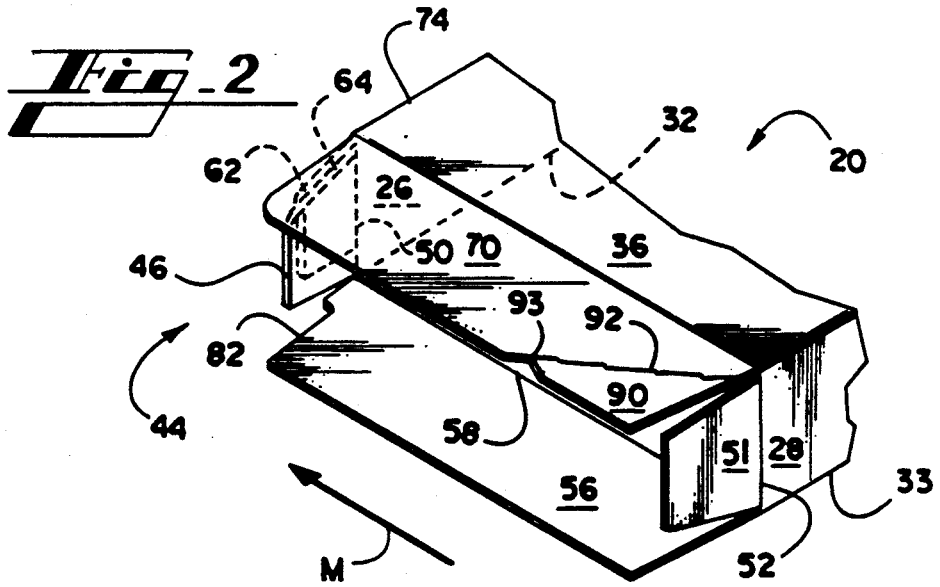
FIG. 2 is a pictorial view of the end construction of the container of the present invention, showing the container in a partially erected configuration prior to the loading of product into the container.
Figure 3:
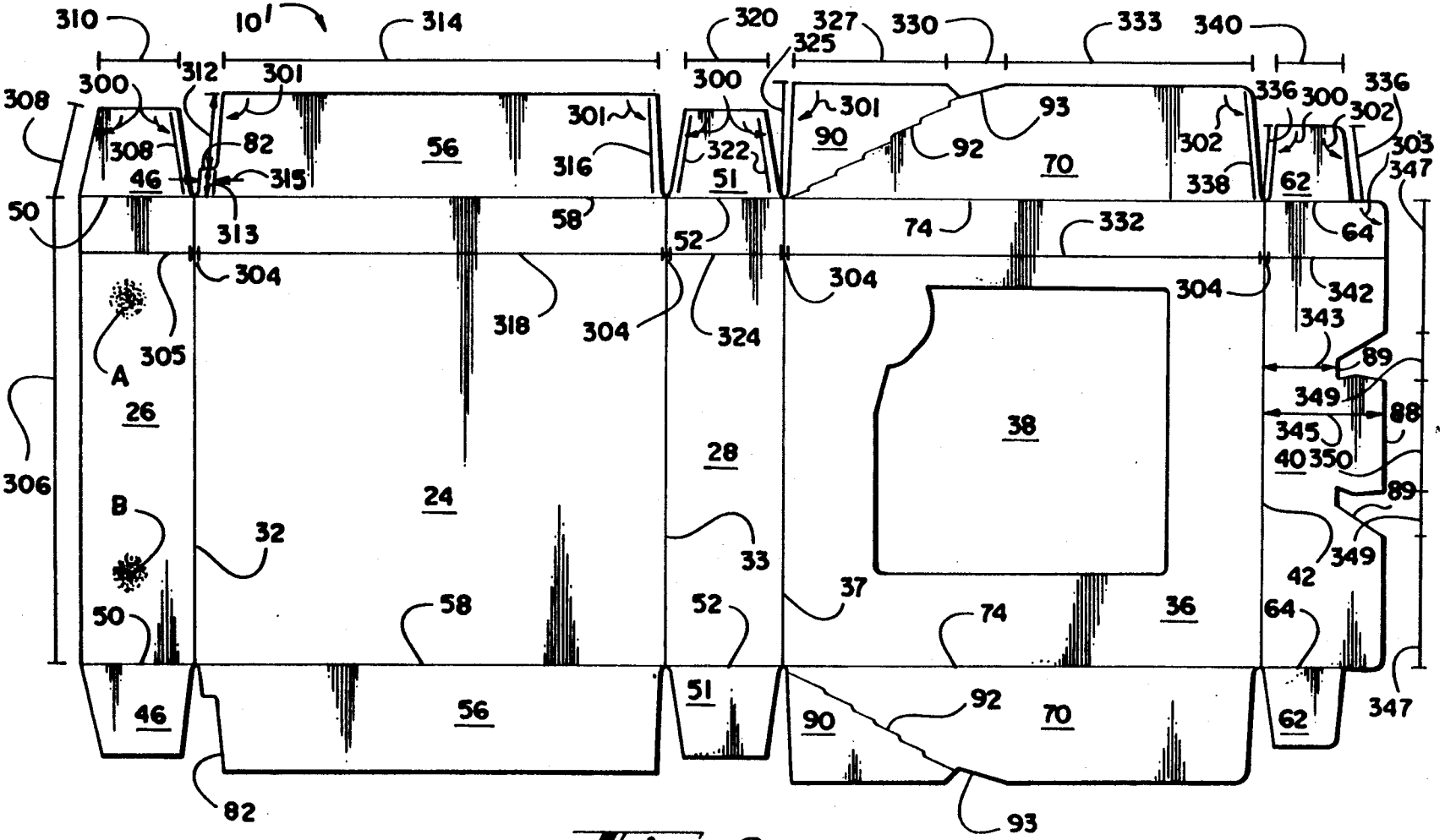
FIG. 3 is a plan view of the blank used to form the container of the present invention.

FIG. 2 shows the flap panels 46, 51, 56, 62, and 70 which form the novel end construction of the container. Both the front end 44 and the rear end 45 have the same structure. The pair of leading minor flap panels 46 are foldably connected to opposite ends of the side panel 26 along scores 50, and the pair of trailing minor flap panels 51 are foldably connected to opposite ends of the side panel 28 along scores 52. The terms "leading" and "trailing" are used with reference to the direction of travel of the sleeve 20 along a conveyor, represented by the arrow M in FIGS. 2 and 4. The pair of inner major flap panels 56 are foldably connected to opposite ends of the bottom panel 24 along scores 58, and each inner major flap panel 56 is positionable to be adhesively secured to exterior facing surfaces of the minor flap panels 46 and 51. The pair of intermediate minor flap panels 62 are foldably connected to opposite ends of the side panel 40 along scores 64, and lie against the outer surface of the leading minor flap panels 46. Each intermediate minor flap panel 62 is removably positionable against the exterior surface of one of the inner major flap panels 56. To allow the intermediate minor flap panels 62 to be removed from contact with the inner major flap panels 56 when the hood 14 is raised from over the tray 12, adhesive is not provided between the intermediate minor flap panels 62 and the inner major flap panels 56. However, it will be understood that a small amount of adhesive may be provided between the panels 56 and 62 as long as the seal formed between each of them is easily broken, such as by gently pulling on the outer major flap panels 70 to which the intermediate flap panels 62 are ultimately secured.

The pair of outer major flap panels 70 are foldably connected to opposite ends of the top panel 36 along scores 74, and each outer major flap panel 70 is positionable to be adhesively secured to the exterior surface of one of the intermediate minor flap panels 62. To permit the leading minor flap panel 46 and the intermediate minor flap panel 62 to be distinguished and independently manipulated by the assembly apparatus 100, the panels 46 and 62 are preferably of different dimensions. For example, in a preferred embodiment, the leading minor flap panel 46 is sized to extend farther out from the side panel 26 than the intermediate minor flap panel 62 extends from the side panel 40, with the leading minor flap panel 46 also extending farther down toward the bottom panel 24 than does the intermediate flap panel 62, as is best shown in FIG. 2.

Figure 4:
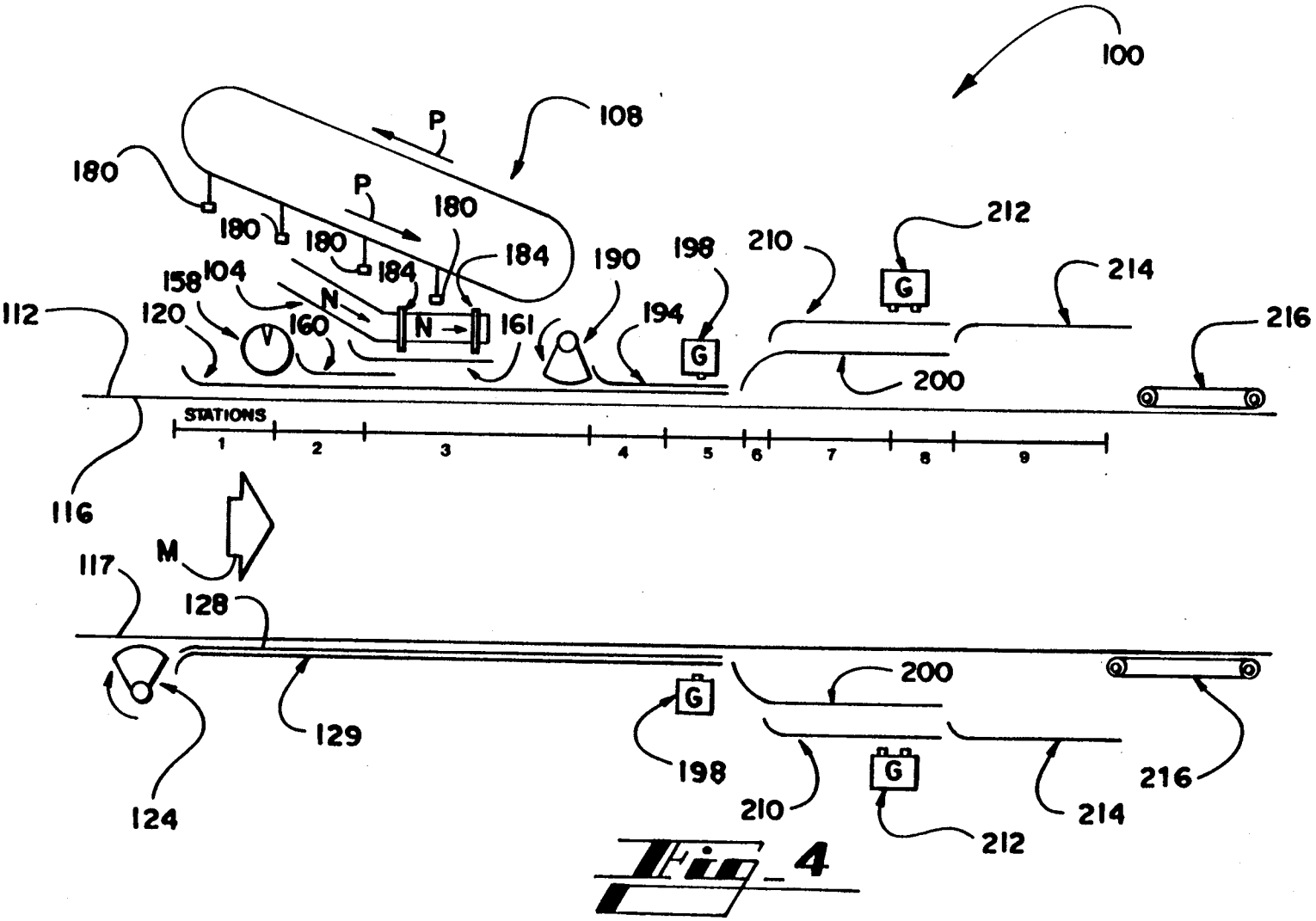
FIG. 4 is a diagrammatical view of a loading/assembly apparatus for loading the sleeve of FIG. 2 and assembling the sleeve into the container of the present invention.

The loading and assembly apparatus 100 is shown in FIG. 4. The apparatus includes a loading carousel 104, a product conveyor 108, a carton conveyor 112 having a loading side 116 opposite a rear side 117, and a series of end assembly Stations, numbered 1–9. Various carton assembly mechanisms and components are positioned along both sides of the carton conveyor 112 at the Stations 1–9 for manipulation of the flap panels 46, 51, 56, 62, and 70 of the sleeves 20 traveling along the carton conveyor 112 in the direction of the arrow M. The components within the Stations 1–9 are represented diagrammatically by the symbols shown in FIG. 4. Each component is of a type well known in the art and is described in more detail below. The components are in practice positioned closely adjacent to the sides of the conveyor 112 where indicated by the symbols in FIG. 4, however, the symbols shown are spaced apart when multiple components are operative in the same Station. A sleeve dispenser Station (not shown) is provided at the beginning of the carton conveyor 112 for erecting and placing sleeves 20 on the carton conveyor. The sleeve dispenser Station may include a suction apparatus (not shown) of a type well known in the art for removing flattened sleeves from a storage magazine and erecting and placing each sleeve 20 between sleeve spacer bars 119 on the carton conveyor 112. The sleeve spacer bars 119 are spaced to maintain the sleeves 20 a predetermined distance apart on the carton conveyor 112.

The spaced apart, erected sleeves 20 travel along the carton conveyor 112 in the direction of the arrow M. The functions performed at the successive Stations 1–9 may be summarized as follows. The sleeves 20 are prepared for the loading of the product 15 into the sleeves 20 in Stations 1–2, loaded with the product 15 in Station 3, and closed in Stations 4–9. Stations 1–2 prepares each sleeve 20 for loading by folding and holding the flap panels 46, 51, 56, 62, and 70 of the front end 44 of each of the sleeves 20 back away from the interior of each sleeve to form a funneled opening 80 at the loading end 44 of each sleeve 20 through which the product 15 is loaded in Station 3. Station 1 also prepares the rear end 45 of each sleeve 20 for loading by folding and holding the inner major flap panel 56 downwardly such that it is out of the way of the inner minor flap panels 46 and 51, and folding and holding the inner minor flap panels 46 and 51 inwardly so that they are positioned within the rear end 45 of each sleeve 20 to prevent the loaded product 15 from exiting the sleeve 20. Station 4 begins closure of the loading end 44 by folding the inner minor flap panels 46 and 51 inwardly to block the opening 80. Stations 5–9 complete closure of the ends 44 and 45 by applying glue to each of the inner minor flap panels 46 and 51; positioning the inner major flap panels 56 against the minor flap panels 46 and 51; positioning the intermediate minor flap panels 62 against the major flap panels 56; applying glue to the intermediate minor flap panels 62 and the inner major flap panels 56; and positioning the outer major flap panels 70 against the intermediate minor flap panels 62 with the tabs 90 against the inner major flap panels 56.

Referring further to FIG. 4, it will be seen that positioned within Station 1 along the loading side 116 of the carton conveyor 112 is an inner major plow bar 120. A kicker blade 124, a minor plow bar 128, and an inner major plow bar 129 are positioned along the rear side 117 of the carton conveyor 112 in Station 1. The inner major plow bar 120 is identical to the inner major plow bar 129. Each inner major plow bar 120 and 129 has an angled rod extending at an angle upwardly toward the carton conveyor 112 and a flat bar extending from the downstream end of each angled rod parallel to and facing the carton conveyor 112. Each angled rod of the plow bars 120 and 129 is positioned to contact one of the inner major flap panels 56 to fold it downwardly and each flat bar of the plow bars 120 and 129 is positioned to maintain one of the inner major flap panels 56 in its folded position. At Station 1, along the rear side 117 of the carton conveyor 112 adjacent the upstream end of the inner major plow bar 129, the kicker blade 124 is mounted for rotation on a drive shaft 148. From the perspective of one facing the rear side 117 of the carton conveyor 112, the rotation of the shaft 148 is in a clockwise direction and is faster than the speed of the carton conveyor 112. The kicker blade 124 is positioned and sequenced in rotation to engage the trailing minor flap panel 51 of the rear end 45 of each sleeve 20 to fold it inwardly as shown in FIG. 5.

Figure 5:
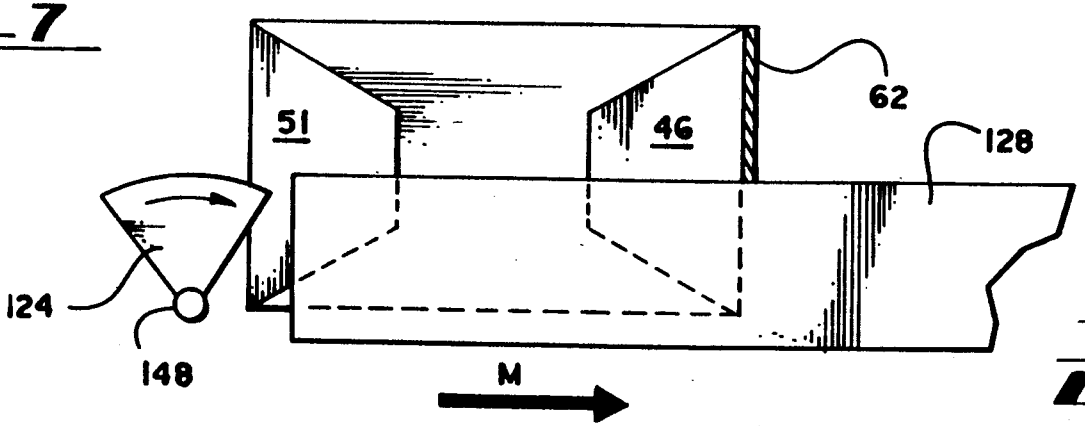
FIG. 5 is a cross-sectional view of a kicker blade and a minor plow bar utilized in Station 1 and Station 4 of the apparatus of FIG. 4.

The minor plow bar 128 is positioned at the downstream edge of the kicker blade 124 to first contact the leading minor flap panel 46 of the rear end 45 of each sleeve 20 to fold it inwardly, and then to maintain the trailing minor flap panel 51 of the rear end 45 of each sleeve 20 in its folded configuration as it passes beyond the kicker blade 124, as shown in FIG. 5. The minor plow bar 128 has an angled section which begins spaced outwardly from the carton conveyor 112 and gradually bends closer to the carton conveyor 112 and then straightens into a straight section which extends from the downstream edge of the angled section of the minor plow bar 128 parallel to the carton conveyor 112. The minor plow bar 128 is positioned at a height to contact the minor flap panels 46 and 51 at a point below the intermediate minor flap panel 62 such that the intermediate minor flap panel 62 passes just above the minor plow bar 128. Thus, it will be appreciated that the size difference between the leading minor flap panel 46 and the intermediate minor flap panel 62, as previously discussed, permits the plow bar 128 to manipulate the minor flap panels 46 and 51 without disturbing the intermediate minor flap panel 62. The inner major plow bars 120 and 129 and the minor plow bar 128 each extend to the downstream end of Station 5.

Positioned along the loading side 116 of the carton conveyor 112, within Station 2, is a slotted disc 158 positioned to fold the inner minor flap panel 56 of the loading end 44 of each sleeve 20 outwardly away from the interior of the sleeve 20. A minor flap bar 160 is positioned adjacent the downstream edge of the disc 158 to contact the minor flap panels 46 and 51 to hold them in their outwardly folded positions, and an outer major plow bar 161 is positioned above the minor flap bar 160 to contact the outer major flap panel 70 to fold and hold the outer major flap panel 70 of the loading end 44 of each sleeve 20 upwardly away from the interior of the sleeve. The flap panels 46, 51, 56, 62, and 70 of the loading end 44 are maintained within this configuration in Station 3 to form the funneled opening 80 through which product is introduced into the sleeve 20.

Figure 6:
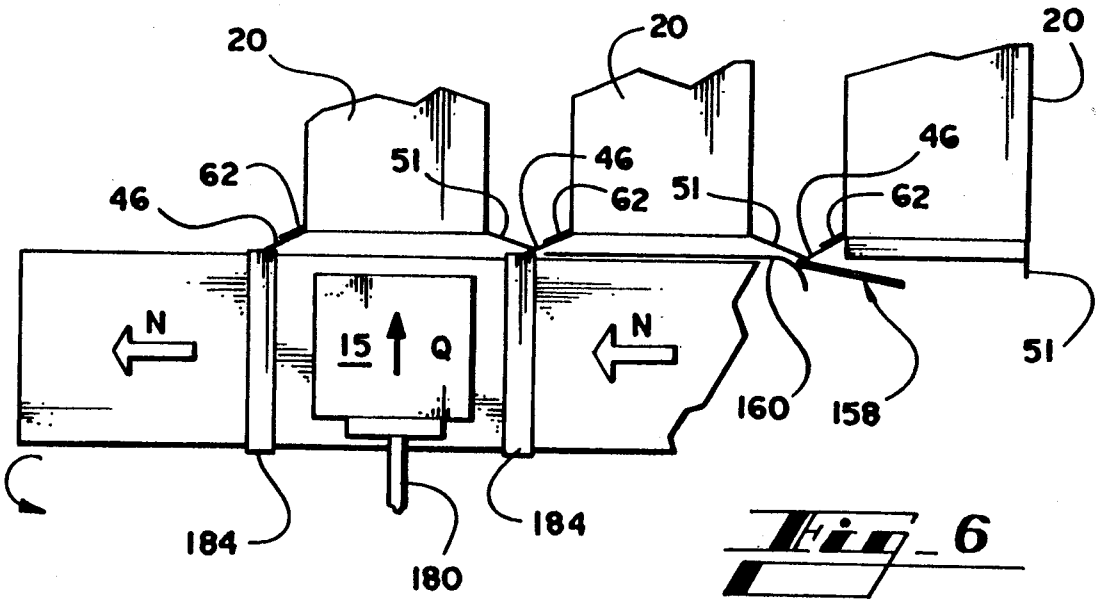
FIG. 6 is an overhead view of Stations 2 and 3 of the apparatus of FIG. 4.
Figure 7:
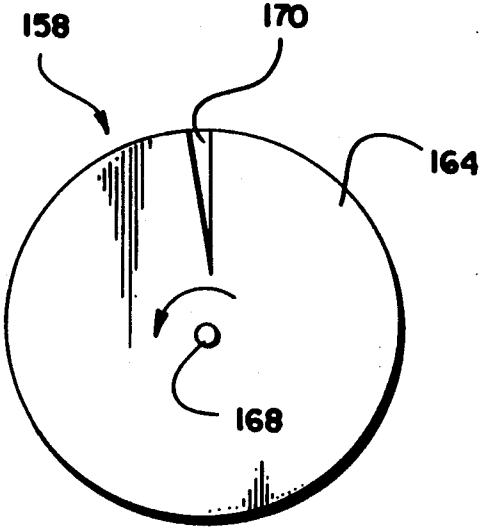
FIG. 7 is a plan view of a tucking disc utilized in the apparatus of FIG. 4.

Referring to FIGS. 6 and 7, the slotted disc 158 is a circular plate 164 centrally mounted on a drive shaft 168 for rotation. From the perspective of one facing the loading side 116, the disc 158 rotates in a counter-clockwise direction. The upstream edge of the disk 158 is preferably positioned slightly farther from the carton conveyor 112 than is the downstream edge of the disk 158. The slotted disc 158 is positioned so that the face of the disc 158 contacts the trailing minor flap panel 51 of the loading end 44 of each sleeve 20 to fold or plow it outwardly away from the interior of the sleeve. The rotation of the slotted disc 158 is faster than the speed of the carton conveyor 112 and is coordinated with the movement of the sleeves 20 along the carton conveyor 112 such that a V-shaped slot 170 cut into the peripheral edge of the disk 158 is positioned to catch the leading minor 46 flap panel of each sleeve 20 to fold each leading minor flap panel 46 outwardly. The sleeves 20 are spaced apart on the carton conveyor 112 by the sleeve spacer bars 119 such that when each leading minor flap panel 46 is outwardly folded by the slot 170, each leading minor flap panel 46 is positioned to overlap the outwardly folded trailing minor flap panel 51 of the preceding sleeve 20, as shown in FIG. 6. Because the intermediate flap panel 62 of each sleeve 20 is positioned behind the leading minor flap panel 46, each intermediate minor flap panel 62 is also plowed back with the leading minor flap panel 46. The minor flap bar 160 is positioned the downstream edge of the disk 158 to contact the minor flap panels 46 and 51 to pick them up from the disc 158 and hold them in their folded positions. The minor flap bar 160 is flat in cross-section and extends along the carton conveyor 112 to the beginning of Station 3, and is of a type which is well known in the art. The outer major plow bar 161 is positioned adjacent to and above the minor flap bar 160 to plow or fold the outer major flap panel 70 upwardly and away from the interior of the sleeve 20. The outer major plow bar 161 is similar in shape to the inner major plow bars 120 and 129 and has an angled rod extending at an angle downwardly towards the carton conveyor 112 and a flat bar extending from the downstream end of the angled rod in a direction parallel to the carton conveyor 112.

Referring again to FIG. 4, it can be seen that the product conveyor 108 is located between the pusher carousel 104 and the carton conveyor 112, and is aligned parallel to the carton conveyor 112 adjacent Station 3 to travel in the direction indicated by arrows P. The pusher carousel 104 has pusher rods 180 positioned to advance the product 15 carried by the product conveyor 108 toward the carton conveyor 112 as the product conveyor 108 advances in the direction of the arrow N. The pusher carousel 104 is angled towards the carton conveyor 112 such that the stroke of the pusher rods 180 pushes the product 15 from the product conveyor 108 in the direction of the arrow Q into the funneled opening 80 of each loading end 44 of each erected sleeve 20 at Station 3, as shown in FIG. 6. The product conveyor 108 has product spacer bars 184 positioned intermediate successive products such that one of the products 15 is positioned adjacent the funneled opening 80 of each of the sleeves 20 as it enters Station 3. To maintain the minor flap panels 46 and 51 in the overlapped position required to form the funneled opening 80, the product spacer bars 184 are positioned along the product conveyor 108 such that each product spacer bar 184 coincides with one of the pairs of overlapped minor flap panels 46 and 51 at the downstream end of Station 2. Thus, as shown in FIG. 6, it will be appreciated that one of the product spacer bars 184 contacts each set of overlapped minor flaps 46 and 51 at the downstream end of the minor flap bar 160 to maintain the minor flap panels 46 and 51 in their overlapped position.

Positioned along the loading side 44 of the carton conveyor 112 within Station 4 is a kicker blade 190 and a minor plow bar 194. The kicker blade 190 and the minor plow bar 194 are identical to the kicker blade 124 and the minor plow bar 128 of the rear side 130 of Station 1, and are positioned to contact the minor flap panels 46 and 51 of the loading end 44 to fold them inwardly.

A glue nozzle 198 is positioned on either side of the carton conveyor 112 at Station 5 to place an amount of glue on the outer surfaces of the inwardly folded minor flap panels 46 and 51 at points C and D, respectively, as they pass by. The ejection of the glue from the glue nozzle 198 can be controlled by mechanical switches, photoelectric devices or other means known in the art of control.

Closure of each end 44 and 45 of the sleeves 20 is completed in Stations 6–9. The apparatus along the loading side 116 at each of the Stations 6–9 is identical to that along the rear side 117. Each side of Station 6 provides an inner major plow bar 200 positioned to contact the inner major flap panels 56 of each sleeve 20 to fold them upwardly, once they have ceased to be held by the inner major plow bars 120 and 129 which terminate at the end of Station 5. The inner major plow bar 200 is of a type well known in the art and is a rod having a curved section which gradually straightens into a straight section. The curved section of the inner major plow bar 200 extends in a smooth curve upwardly and downstream from the inner major plow bars 120 and 129. The curved section of each major plow bar 120 extends a horizontal distance along the carton conveyor 112 sufficient to guide the inner major flap panel 56 of each sleeve 20 to its upwardly folded position. The curved section of the inner major plow bar 200 decreases in curvature at its apex such that the straight section of each inner major plow bar 200 extends from the downstream edge of the curved section to the end of Station 8. The straight section of each inner major plow bar 200 is positioned parallel to and above the carton conveyor 112 to contact the exterior surface of each inner major flap panel 56 below each intermediate flap panel 62 to maintain each inner major flap panel 56 in its folded position.

Station 7 provides an intermediate plow bar 210 on each side of the carton conveyor 112 which is positioned to connect each intermediate minor flap panel 62 to fold it inwardly against each inner major flap panel 56. Each intermediate plow bar 210 has a flat section preceeded by a curved section to guide the intermediate flap panel 62 into the flat section. The intermediate plow bars 210 each extend parallel to the carton conveyor 112 from the end of Station 6 to the end of Station 8. The intermediate plow bars 210 are each positioned vertically above one of the outer major plow bars 200 such that each contacts one of the intermediate minor flap panels 62 without interferring with the outer major flap panels 70 as they pass by.

Station 8 provides a pair of glue nozzles 212 on each side 116 and 117 of the carton conveyor 112. The glue nozzles 212 of each side are positioned adjacent to one another such that one of the nozzles on each side of the carton conveyor 112 may place an amount of glue on the outer surface of each inner major flap panel 56 as it passes by, under the eventual position of the tab 90. The other of the nozzles may place an amount of glue on the outer surface of each intermediate minor flap panel 62 as it passes by. The ejection of the glue from the glue nozzles can be controlled by mechanical switches, photoelectric devices or other means known in the art of control.

Section 9 provides an outer major plow bar 214 on each side of the carton conveyor to contact each outer major flap panel 70 as it passes by to fold it downwardly against each intermediate minor flap panel 62. Each outer major plow bar 214 is a rod having a curved section positioned to guide the outer major flap panels 70 to their folded position and a straight section for holding the outer major flap panels 70 in their folded position.

Adjacent the downstream end of Station 9 on each side of the carton conveyor 112 is a pressure roller 216 positioned to apply pressure to each closed end 44 and 45 of the container 10. The pressure rollers 216 are conveyor belts mounted on rollers, and are well known in the art.

Plow bars similar to those described above and glue nozzles similar to those described above are shown in U.S. Pat. No. 4,592,190, incorporated herein by reference. A kicker blade similar to the kicker blades described above is shown in U.S. Pat. No. 4,759,167, incorporated herein by reference.

FIGS. 8A–16A show the loading end 44 of one of the sleeves 20 as it progresses through each of the Stations 1–9. FIGS. 8B–16B show the rear end 45 of the same sleeve 20 as it progresses through each of the Stations 1–9. As previously discussed, the flattened sleeves are removed from the storage magazine (not shown), erected, and placed on the carton conveyor 112 by the suction apparatus (not shown). Each sleeve 20 is advanced through the Stations 1–9 for loading and assembly. Each sleeve 20 is prepared for loading in Stations 1 and 2, loaded in Station 3, and assembled in Stations 4–9.

Stations 1 and 2

Figures 8A, 8B, 9A, 9B, 10A, 10B:
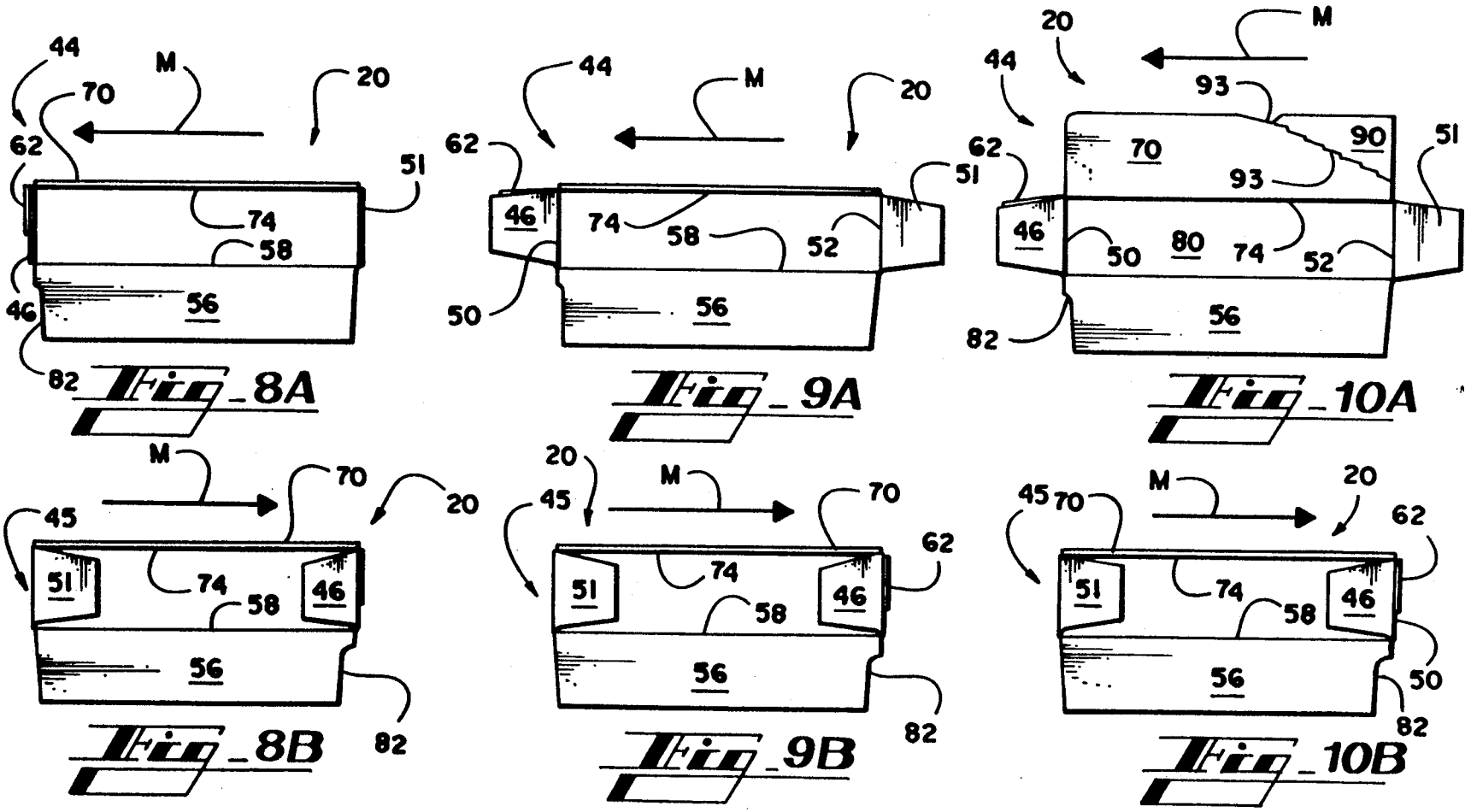

Each sleeve 20 has been prepared for loading once it exits Station 2. At this point each of the panels 46, 51, 56, 62, and 70 of the loading end 44 has been positioned such that each panel 46, 51, 56, 62 and 70 of the loading end 44 is folded back along its respective score and held away from the interior of the sleeve 20 to form an angle of between about 45° and 90° with the panel to which it is connected, as shown in FIG. 10A. In this manner the folded back panels 46, 51, 56, 62, and 70 are positioned to form the funneled opening 80 for introducing product into the sleeve 20. FIG. 8A shows the loading end 44 as it exits Station 1. FIG. 9A shows the loading end as it passes through Station 2. FIG. 10A shows the loading end as it exits Station 2 and as it continues through Station 3.

Referring in more detail to FIGS. 8-A, B to 10-A, B, when each sleeve 20 is erected and placed on the carton conveyor 112, the flap panels 46, 51, 56, 62, and 70 of each end 44 and 45 are initially substantially parallel to the panel to which they are connected and extend outwardly of the sleeve 20, as shown in FIG. 2. When each sleeve 20 passes through Station 1, the inner major flap panel 56 of the loading end 44 of each sleeve 20 contacts the angled rod of the inner major plow bar 120 and is folded downwardly and away from the interior of the sleeve 20, as shown in FIG. 8-A. The flat bar of the inner major plow bar 120 contacts a portion of the inner major flap panel 56 to maintain the inner major flap panel 56 in this folded position until the end of Station 5. The remaining panels 46, 51, 62, and 70 of the loading end 44 are unaffected by Station 1.

In Station 2, the minor flap panels 46, 51, and 62 of the loading end 44 are shown folded outwardly from the interior of the sleeve 20 (FIG. 9-A) and the outer major flap panel 70 is shown folded upwardly away from the interior of the sleeve 20 (FIG. 10-A). Referring now to FIG. 6 there is shown a pair of the sleeves 20 passing by the slotted disc 158 in Station 2. As the leading minor flap panel 46 of each sleeve 20 passes through Station 2, the rotation of the disc 158 is sequenced with the carton conveyor 112 such that the leading minor flap panel 46 of each sleeve 20 is caught by the slot 170 on the disk 158 and is kicked outwardly away from the interior of the sleeve 20. The intermediate minor flap panel 62 of each sleeve 20 is caught behind the leading minor flap panel 46 and is also folded back. The trailing minor flap panel 51 of each sleeve 20 then contacts the disc 158 as it advances through Station 2 and is folded back by the disk 158. The sleeves 20 are spaced apart on the carton conveyor 112 by the sleeve spacer bars 119 such that when the leading minor flap panel 46 of each sleeve 20 is folded back it overlaps the trailing minor flap panel 51 of the preceding sleeve 20. The minor panel plow bar 128 positioned parallel to the carton conveyor 112 then contacts the overlapped minor flap panels 46 and 51 as they proceed through Station 2 to hold the minor flap panels 46 and 51 in their overlapped position as they enter Station 3. After the minor flap panels 46 and 51 have been folded back in Station 2, the outer major flap panel 70 which is substantially parallel to the top panel 36 in its unfolded position contacts the outer major plow bar 161 such that it is folded upwardly and held away from the interior of the sleeve 20, as shown in FIG. 10-A. The outer major plow bar 161 maintains the outer major flap panel 70 in this position until the product 15 has been loaded into the sleeve 20 in Station 3.

To prevent the product 15 from sliding out of the rear end 45 of the sleeve 20 when the product 15 is loaded, the leading minor flap panel 46 and the trailing minor flap panel 51 of the rear end 45 are positioned in Station 1 to block the rear end 45. Prior to the folding of the minor flap panels 46 and 51 of the rear end 45, the inner major flap panel 56 of the rear end 45 is folded downwardly and away from the interior of the sleeve 20 to remove the inner major flap panel 56 of each sleeve 20 from the path of the kicker blade 124 and the minor plow bar 128 which act in concert to fold the minor flap panels 46 and 51. FIGS. 8B–10B show the rear end 45 of the sleeve 20 as it exits Stations 1, 2, and 3.

As stated earlier, the panels 46, 51, 56, 62, and 70 of the sleeves 20 are positioned outwardly of and parallel to the sleeve 20 after the sleeves are erected, as shown in FIG. 2. In passing through Station 1, the outwardly positioned inner major flap panel 56 of the rear end 45 of each sleeve 20 contacts the angled rod of the inner major plow bar 120 and is folded downwardly. The flat bar of the inner major plow bar 120 then contacts the inner major flap panel 56 of each sleeve 20 to maintain it in this folded position until the end of Station 5. After the inner major flap panel 56 of each sleeve 20 has been folded, the minor flap panels 46 and 51 of each sleeve 20 are folded inwardly and positioned substantially perpendicular to the panels to which they are connected, between the top panel 36 and the bottom panel 24. The thus folded minor flap panels 46 and 51, shown in FIGS. 8B–10B, thereby block the rear end 45 of the sleeve 20 to prevent the product 15 from passing out of sleeve 20 through the rear end 45. As each sleeve 20 continues through Station 1, the minor flap panels 46 and 51 of the rear end 45 are inwardly folded and held by the angled rod of the minor plow bar 128 until the end of Station 5 as follows. After the inner major flap panel 56 of the rear end 45 is folded, the leading minor flap panel 46 contacts the angled rod of the minor plow bar 128 and is guided to its folded position behind the flat bar of the minor plow bar 128 which maintains the leading minor flap panel 46 in its folded position. The intermediate flap panel 62 is unaffected because the minor plow bar 128 is positioned below the intermediate flap panel 62 so that the intermediate minor flap panel 62 passes above the minor plow bar 128 due to the size difference between the minor panels 46 and 51 and the intermediate panel 62. The rotation of the kicker blade 124 is sequenced with the advancement of the trailing minor flap panel 51 into the minor plow bar 128 such that the kicker blade 124 contacts the trailing minor flap panel 51 to fold it inward for capture behind the flat bar of the minor plow bar 128. The flat bar of the minor plow bar 128 holds the minor flap panels 46 and 51 in this position until the end of Station 5.

Station 3

When each sleeve 20 enters Station 3, the flap panels 46, 51, 56, 62, and 70 of the rear end 45 are positioned as shown in FIG. 10-B to prevent the product 15 from exiting the sleeve 20 through the rear end 45. The rear end 45 is maintained in this configuration until the end of Station 5. When each sleeve 20 enters Station 3, the flap panels 46, 51, 56, 62, and 70 of the loading end 44 are positioned to form the funneled opening 80, as shown in FIG. 10-A. Because the minor plow bar 128 holding the overlapped minor flap panels 46 and 51 would be in the way of loading, the minor plow bar 128 terminates at the beginning of Station 3. As the overlapped flap panels 46 and 51 enter Station 3, they are contacted by one of the product spacer bars 184 positioned on the product conveyor 108. The product spacer bars 184 contact the overlapped flap panels 46 and 51 on either side of the product 15 to maintain the panels 46 and 51 in their overlapped position without interferring with the movement of product 15 into the sleeve 20, as shown in FIG. 6. As is also shown in FIG. 6, the product 15 is slidably inserted into each sleeve 20 by one of the pusher rods 180 in Station 3. The loaded sleeve 20 then advances through Station 4–9 for closure of the ends 44 and 45.

Station 4

Figure 11A:
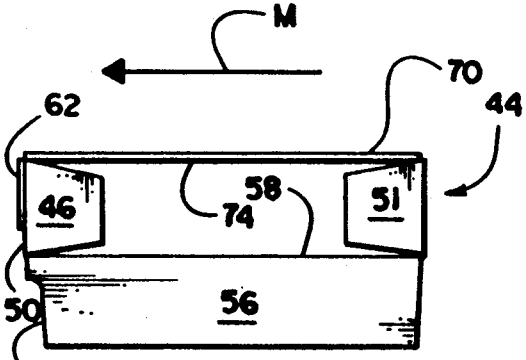
Figure 11B:
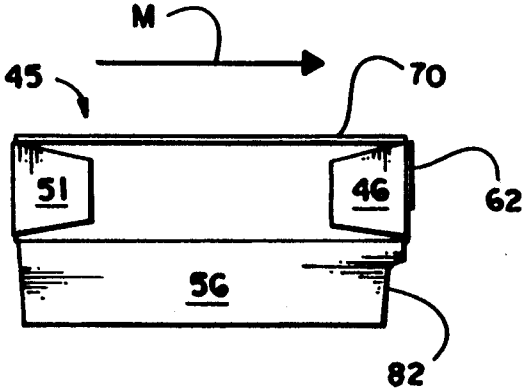

The rear end 45 of the loaded sleeve 20 is not manipulated as the sleeve 20 proceeds through Station 4, apart from the minor flap panels 46 and 51 and the inner major flap panel 56 of each sleeve being maintained in their folded positions. The loading end 44 is manipulated in Station 4 such that at the exit of Station 4 the inner minor flap panels 46 and 51 are inwardly folded such that each of the panels 46 and 51 is substantially perpendicular to the panel to which it is connected between the top panel 36 and the bottom panel 24. Also in Station 4 the outer major flap panel 70 of the loading end 44 is released and allowed to return to its initial position, as shown in FIG. 11-A. The minor flap panels 46 and 51 of the loading end 44 of each sleeve 20 are folded inwardly by the kicker blade 190 and the minor plow bar 194 in the same manner as the minor flap panels 46 and 51 of the rear end 45 were folded in by the kicker blade 124 and minor plow bar 128 in Station 1. The outer major plow bar 161 which held the outer major flap panel 70 in its upwardly folded position through Stations 2 and 3 terminates at the end of Station 3, and the outer major flap panel 70 returns to its original position such that it extends outwardly from the interior of the sleeve 20 and is substantially parallel to the top panel 36.

Station 5

Figure 15A:
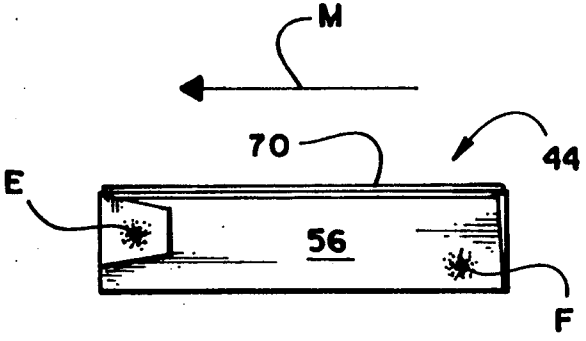
Figure 15B:
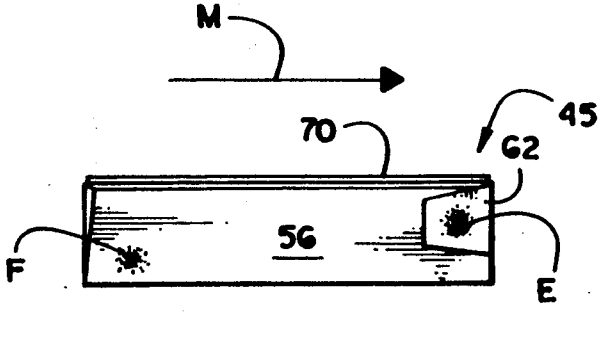

Glue is applied to points C and D, respectively on the outer surface of each leading minor flap panel 46 and trailing minor flap panel 51. in Station 5 so that in Station 6 the inner major flap panel 56 of each sleeve 20 may be folded against and secured to the minor flap panels 46 and 51, as shown in FIG. 15-A (loading end) and FIG. 15-B (rear end). The inner major plow bars 120 and 120 and the minor plow bar 128 terminate at the end of Station 5 so that the inner major flap panel 56 may be folded against the minor flap panels 46 and 51 in Station 6.

Station 6–9

Figure 13A:
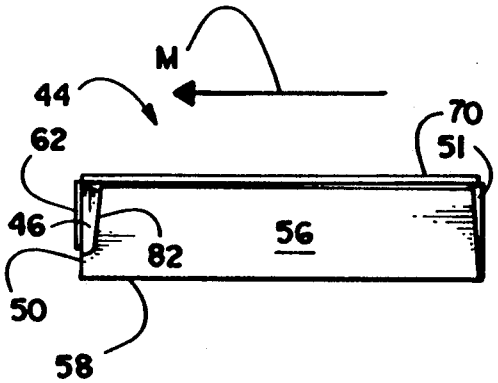
Figure 13B:
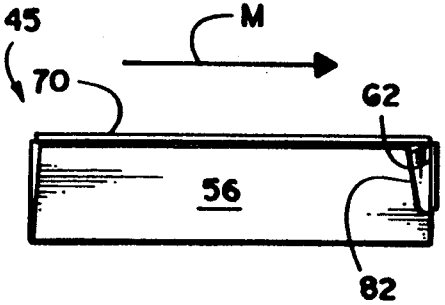
Figure 12A:
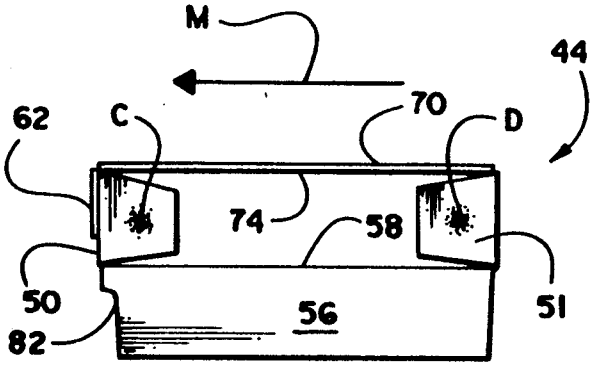
Figure 12B:
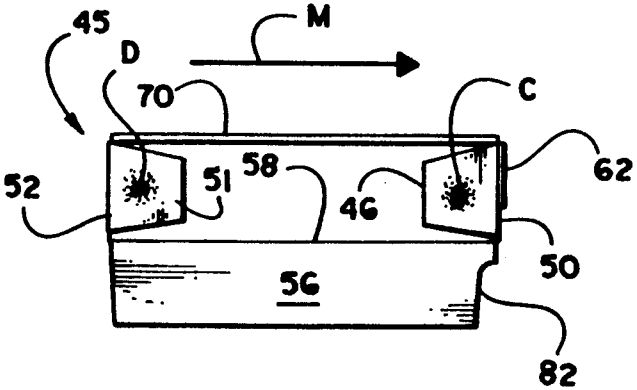
Figure 16A:
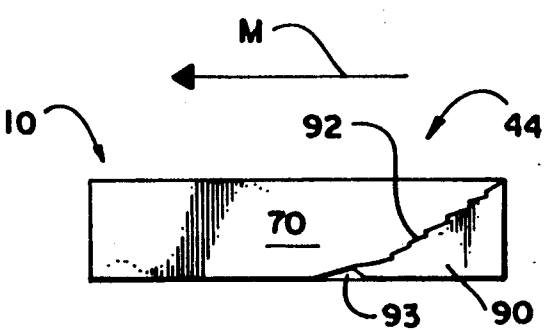
Figure 16B:
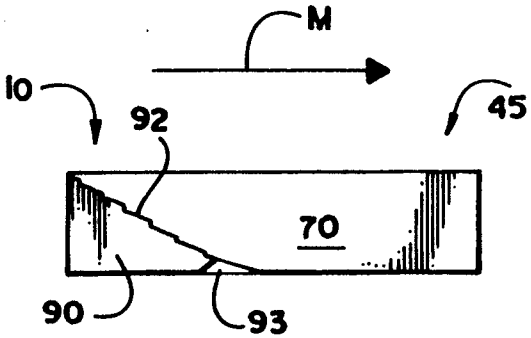
Figure 14A:
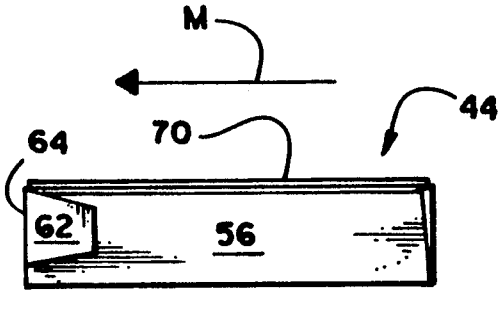
Figure 14B:
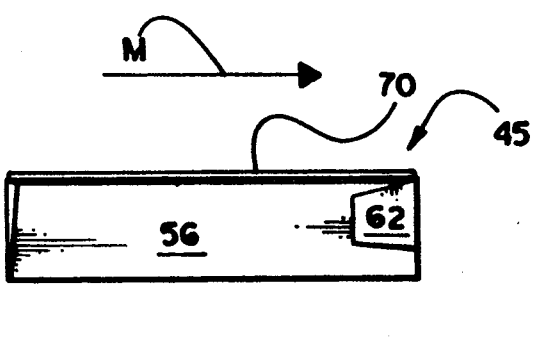

Stations 6–9 manipulate the ends 44 and 45 in the same manner to complete closure of each end. In Station 6, the inner major flap panel 56 of each end 44 and 45 is folded upwardly by the inner major plow bars 200 to position the inner major flap panels 56 against the minor flap panels 46 and 51. The inner major flap panels 56 of each sleeve 20 are thereby secured to the minor flap panels 46 and 51 by the glue at points A and B, as shown in FIG. 13-A (loading end) and FIG. 13-B (rear end). FIGS. 14-A and 14-B show the ends 44 and 45, respectively, of one of the sleeves 20 after it has passed through Station 7. As each end 44 and 45 enters Station 7, the intermediate minor flap panels 62 contact the intermediate plow bars 210 such that the intermediate minor flap panels 62 are positioned and held aaainst the inner major panels 56. Glue is applied to point E on each intermediate minor flap panel 62 and to point F on each inner major flap panel 56 by the pair of glue nozzles 212 on each side of the carton conveyor 112 in Station 8, as shown in FIGS. 15-A (loading end) and 15-B (rear end). To complete assembly, the outer major flap panel 70 of each end 44 and 45 are then folded downwardly by the outer major plow bars 214 so that the outer major flap panels 70 of each end are positioned against and secured to the intermediate flap panels at point E and the tabs 90 on each outer major flap panels 70 are positioned against and secured to the inner major flap panels at point F, as shown in FIGS. 16A and 16B.

To open the assembled container 10 to provide the tray 12 and the hooded top 14, the locking panel 40 is urged apart from the side panel 26 to break the glue seal at points A and B. The lift tab 88 centrally provided on the side panel 40 intermediate the cutouts 89 facilitates separation of the side panel 40 from the side panel 26. The lift tab 88 may also be adhesively secured to the side panel 26 at point G using an easily broken adhesive seal to maintain a flat profile. The lift tab 88 may be removed from the side panel 40 by severing the tear score 91, to facilitate opening of the container 10 to provide the tray 12 and the hooded top 14. Once the glue seal at points A, B, and G are broken, the side panel 40 is separable from the side panel 26, but is still attached to the outer major flap panel 70 by the intermediate minor flap panel 62. The resulting structure consisting of the top panel 36, the side panel 40, the outer major flap panel 70, and the intermediate flap panel 62, forms the hooded top 14. The remainder of the components, the bottom panel 24 and the side panels 26 and 28, attached to the inner major flap panel 56 by the minor flap panels 46 and 51, form the tray 12. The hooded top 14 may be lifted and rotated about the score 37 to provide the broad top opening 86 for accessing product. The tab 90 is provided to maintain the trailing edge of the outer major flap panel 70 flat so that it does not stick out and to provide evidence of unauthorized opening of the container. The tear score 92 is provided diagonally across the lowermost, trailing corner of each of the outer major flap panels 70 to allow the tabs 90 to be separable from the outer major flap panels 70. When the hooded top 14 is raised upwardly from the tray 12 the tear score 92 tears and separates the tab 90 from the rest of the outer major flap panel 70 to evidence opening of the container 10. A notch 93 is provided below the score 92 to provide a fingerhold to facilitate tearing of the score 92. To re-close the container after product has been returned to the tray 12, the hooded top 14 is lowered to return the container to its closed configuration.

To facilitate assembly of the container using automated equipment, the components of the ends of the container 10 are configured to reduce interference between components. Referring to FIG. 3, the following measurements illustrate one example of dimensions useful to construct a container in accordance with the present invention. It will be understood that various shapes and sizes of containers may be accomplished without departing from the spirit and scope of the invention.

| Distance | Approximate Measurement |
|---|---|
| 300 | 97° angle |
| 301 | 93° angle |
| 302 | 93° angle, 7/16" diameter corner curve |
| 303 | 93° angle, ¼" diameter corner curve |
| 304 | ⅛" |
| 305 | 1 21/32" |
| 306 | 7 1/16" |
| 308 | 1⅜" |
| 309 | 1⅝" |
| 310 | 1 5/32" |
| 312 | 1⅛" |
| 313 | 7/16" |
| 314 | 6 9/16" |
| 315 | ¼" |

-continued

| Distance | Approximate Measurement |
|---|---|
| 316 | 1⅝" |
| 318 | 6 15/16" |
| 320 | 1¼" |
| 322 | 1⅜" |
| 324 | 1⅝" |
| 325 | 1¾" |
| 327 | 2 5/16" |
| 330 | ⅞" |
| 332 | 6 15/16" |
| 333 | 3½" |
| 336 | 1 3/16" |
| 338 | 1¾" |
| 340 | 15/16" |
| 342 | 1⅛" |
| 343 | 1 1/16" |
| 345 | 1 11/16" |
| 347 | 2 1/16" |
| 349 | ⅜" |
| 350 | 1 11/16" |

The foregoing descriptions of preferred embodiments of the present invention are given by way of illustration. In light thereof, those of ordinary skill in the art will appreciate that various modifications may be made without departing from the spirit and scope of the present invention.

We claim:

1. An end construction for a sleeve-type container loadable through said end, said end construction comprising:

a bottom panel;

a first side panel and a second side panel extending upwardly from opposite sides of said bottom panel;

a top panel foldably connected to an uppermost longitudinal edge of said first side panel and positioned in a spaced apart relation to said bottom panel;

a third side panel extending downwardly from said top panel, said third side panel positioned in parallel, abutting relationship with an exterior surface of said second side panel;

a first minor flap panel foldably connected to an end of said first side panel, said first minor flap panel foldably positioned between said bottom panel and said top panel, substantially perpendicular to said first side panel;

a second minor flap panel foldably connected to an end of said second side panel, said second minor flap panel foldably positioned between said bottom panel and said top panel, substantially perpendicular to said second side panel;

an inner major flap panel foldably connected to an end of said bottom panel, said inner major flap panel foldably positioned against and secured to said first minor flap panel and said second minor flap panel;

an intermediate minor flap panel foldably connected to an end of said third side panel, said intermediate minor flap panel removably positioned against an outer surface of said inner major flap panel substantially perpendicular to said third side panel; and an outer major flap panel foldably connected to an end of said top panel, said outer major flap panel foldably positioned against and secured to said intermediate flap panel;

said inner major flap panel including a cutout along an edge of said inner major flap panel, said cutout being perpendicular to the fold connecting said bottom panel to said one of said inner major flap panels and being located at the end of said one of said inner major flap panels which is adjacent said second side panel.

2. An end loading container formed from a blank of foldable sheet material, said container comprising:

a tray, comprising:

a bottom panel, a first side panel and a second side panel extending upwardly from opposite sides of said bottom panel, a pair of first minor flap panels, one foldably connected to each end of said first side panel, each of said first minor flap panels positioned substantially perpendicular to said first side panel between said first and second side panels, a pair of second minor flap panels, one foldably connected to each end of said second side panel, each of said second minor flap panels positioned substantially perpendicular to said second side panel between said first and second side panels, and a pair of inner major flap panels, one foldably connected to each end of said bottom panel, each of said inner major flap panels positioned against and secured to one of said first minor flap panels and one of said second minor flap panels, at least one of said inner major flap panels defining a cutout along an edge of said inner major flap panel, said cutout being perpendicular to the fold connecting said bottom panel to said one of said inner major flap panels and being located at the end of said one of said inner major flap panels which is adjacent said second side panel; and a hooded top foldably connected to said tray for closing over said tray, said hooded top comprising:

a top panel foldably connected to an uppermost edge of said first side panel such that said top panel may be positioned substantially parallel to and spaced apart from said bottom panel when said hooded top is closed over said tray;

a third side panel extending from said top panel such that said third side panel may be removably positioned in parallel, abutting relationship with said second side panel when said hooded top is closed over said tray, a pair of intermediate minor flap panels, one foldably connected to each end of said third side panel, each of said intermediate minor flap panels positioned substantially perpendicular to said third side panel adjacent said top panel such that each of said intermediate minor flap panels may be removably positioned against an outer surface of one of said inner major flap panels when said hooded top is closed over said tray, and a pair of outer major flap panel foldably connected to each end of said top panel, each of said outer major flap panels positioned against and secured to one of said intermediate minor flap panels.

3. An end-loading container formed from a blank of foldable sheet material, said container comprising:

a bottom panel;

a first side panel and a second side panel extending upwardly from opposite sides of said bottom panel;

a top panel foldably connected to an uppermost longitudinal edge of said first side panel and extending substantially parallel to and spaced apart from said bottom panel;

a third side panel extending downwardly from said top panel, said third side panel positioned in parallel, abutting relationship with an exterior surface of said second side panel;

a pair of first minor flap panels, one foldably connected to each end of said first side panel, each of said first minor flap panels foldably positioned between said bottom panel and said top panel, substantially perpendicular to said first side panel;

a pair of second minor flap panels, one foldably connected to each end of said second side panel, each of said second minor flap panels foldably positioned between said bottom panel and said top panel, substantially perpendicular to said second side panel;

a pair of inner major flap panels, one foldably connected to each end of said bottom panel, each of said inner major flap panels foldably positioned against and secured to one of said first minor flap panels and one of said second minor flap panels and defining a cutout along an edge of each of said inner major flap panels, each of said cutouts being parallel and adjacent to the folds connecting said intermediate flap panels to said third side panel;

a pair of intermediate minor flap panels, one foldably connected to each end of said third side panel, each of said intermediate minor flap panels removably positioned against an outer surface of one of said inner major flap panels substantially perpendicular to said third side panel; and a pair of outer major flap panels, one foldably connected to each end of said top panel, each of said outer major flap panels foldably positioned against and secured to one of said intermediate flap panels.

4. The container of claim 3, further comprising a tab detachably connected along a lowermost corner of at least one of said outer major flap panels spaced away from said second side panel.

5. The container of claim 3, wherein at least one of said second minor flap panels is sized to extend farther out from said second side panel than the intermediate minor flap panels at the same corner of said container extend out from said third side panel at the same corner of said container, each of said extending second minor flap panels also extending farther down toward said bottom panel than do said intermediate minor flap panels at the same corner of said container.

6. The container of claim 3, wherein said intermediate flap panels extend across said cutouts and lie against at least a part of said inner major flap panels.

* * * * *